US006314776B1

(12) United States Patent
Puda

(10) Patent No.: US 6,314,776 B1
(45) Date of Patent: Nov. 13, 2001

(54) SIXTH ORDER ACTUATOR AND MILL SET-UP SYSTEM FOR ROLLING MILL PROFILE AND FLATNESS CONTROL

(75) Inventor: Mark E. Puda, Cheswick, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/677,622

(22) Filed: Oct. 3, 2000

(51) Int. Cl.[7] ..... B21B 37/58

(52) U.S. Cl. ..... 72/10.1; 72/12.2; 72/201; 72/247; 72/366.2

(58) Field of Search ..... 72/9.1, 10.1, 10.2, 72/11.7, 201, 247, 366.2, 8.5, 11.3, 12.2

(56) References Cited

U.S. PATENT DOCUMENTS

| | | | | |
|---|---|---|---|---|
| 4,726,213 | * | 2/1988 | Mancho | 72/247 |
| 4,776,192 | * | 10/1988 | Oda et al. | 72/247 |
| 4,800,742 | | 1/1989 | Feldmann et al. | 72/247 |
| 4,823,585 | * | 4/1989 | Hishinuma et al. | 72/247 |
| 4,881,396 | | 11/1989 | Seidel et al. | 72/247 |
| 5,651,281 | * | 7/1997 | Seidel | 72/9.2 |
| 6,119,500 | * | 9/2000 | Ginzburg et al. | 72/247 |

FOREIGN PATENT DOCUMENTS

| | | | | |
|---|---|---|---|---|
| 62-158513 | * | 7/1987 | (JP) | 72/247 |

* cited by examiner

*Primary Examiner*—Ed Tolan
(74) *Attorney, Agent, or Firm*—Charles Q. Buckwalter; Julie W. Meder; Edward L. Levine

(57) ABSTRACT

A rolling mill stand having a pair of side shiftable rolls defining a roll gap profile therebetween varying along the length of the rolls according to a sixth order polynomial equation. The flatness of the strip exiting the rolling mill stand is controlled by determining the temperature profile of the rolls and adjusting the side shift positions of the rolls to compensate for the expansion of the rolls due to changes in the temperature of the rolls.

15 Claims, 4 Drawing Sheets

6'th Order Ground Roll Profile
Roll Diameter Difference / Equivalent Roll Crown

Predicted Strip Shape - 6'th Order and Parabolic
75" Wide Strip / Steady State Thermal Camber Profile/Flatness Control
Using 6'th Order Roll Crown and Side Shifting Work Rolls

SIXTH ORDER ACTUATOR AND MILL SET-UP SYSTEM FOR ROLLING MILL PROFILE AND FLATNESS CONTROL

BACKGROUND OF THE INVENTION

1. Field of the Invention

The present invention relates to a rolling mill stand having rolls that are axially slidable with respect to each other, more particularly, to work rolls or intermediate rolls having a seventh order polynomial surface profile which together form an adjustable gap with a sixth order profile.

2. Prior Art

Strip product such as aluminum is typically rolled in a four high or six high rolling mill stand. Recently, the demand for thin aluminum strip product has increased, particularly for the beverage can industry. For such applications, the strip must be hot rolled to as thin as 0.090 inch with minimal variations in flatness. Flatness defects should be avoided and the strip should have a constant thickness over its entire length. To avoid unevenness of the strip, it is necessary to roll the strip uniformly over its width, so that internal stresses are avoided which could lead to undesirable undulations in the middle area, the edge area or the quarter area of the strip. Such internal stresses typically result in edge cracking during hot rolling and subsequent cold rolling which requires that sections of the coil with large cracks be cut away and scrapped. If edge cracking occurs in the middle of a coil, the entire coil may need to be scrapped.

Strip flatness defects are due in part to the forces exerted on the rolls from the strip, referred to as bending deflections, and alterations in the diameter of the rolls which develop across the length of the rolls. These alterations are caused by the force of the strip flattening the rolls and by thermal expansion of the rolls which creates a thermal camber on the roll surfaces. The mid-point of the roll is the hottest, hence the thermal expansion of rolls is greatest at the mid-point of the rolls and decreases towards the ends of the rolls. The resulting roll gap profile is uneven across the length of the rolls which creates uneven rolling across the width of the strip. Uniform rolling can only occur if the roll gap profile under load is properly adjusted by means of adjusting mechanisms.

One such adjusting mechanism is a bending jack. Bending jacks are applied to the neck of the roll to exert a force to compensate for the bending deflections and thermal camber. The jacking force is designed to counter the vertical shift in the roll surface at the roll mid-point by bending the ends of the roll, so surfaces of the ends of the roll are in the same plane as the roll mid-point. While bending jacks compensate for bending deflections very well because they are both parabolic in their functional form the roll gap profile may still not be sufficiently corrected to produce thin strip with acceptable flatness in situations where the thermal profile of the work rolls has a large magnitude and steep drop off at the edges of the strip. In these situations, use of parabolic actuators such as bending jacks and traditional ground work roll crowns will not provide the required compensation and quarter buckle flatness defects will appear in the sheet. Additionally, use of bending actuators with fixed roll crowns may not provide adequate adjustment range for mills that process a wide range of products of different material hardness and strip width.

One system for accommodating the characteristics of various rolled products and varying thermal crown on the work rolls is described in U.S. Pat. No. 4,881,396. Axially slidable rolls are shaped in such a way that the effect resulting firom the contours of two rolls can be determined by the relative axial displacement of the rolls. A roll gap of various parabolic and quartic shapes can be created by adjusting the shift position of the rolls to tailor the mill to the characteristics of the product being rolled. Bottle shaped rolls may be operated to provide a continuously variable crown (CVC) capable of compensating for parabolic bending over the entire length of the roll bodies and the effect of thermal camber build-up if the magnitude and steepness are not too great and the strip is fairly thick. However, while such CVC rolls provide more flexibility and actuator range to roll a broad product mix, they may not completely compensate for the thermal profile of the roll and still may produce wavy sections of the strip.

The '396 patent further describes using rolls having profiles described as fourth order polynomials to reduce the waviness in the edge or quarter areas of the strip. Such fourth order polynomial roll gap profiles have improved strip quality yet still have not completely eliminated quarter buckle flatness defects particularly when the temperature of the rolls is high during high speed rolling and/or high reduction. In an multi-stand aluminum hot rolling mill, the strip typically enters the first mill stand at about 750° F. and exits the mill stand at about 650° F. The rolls are continually sprayed with a coolant such as a water and oil mixture. The centers of the rolls are typically about 215° F. and the edges of the roll are about 190° F. The temperature differences across the length of the roll (the temperature profile of the roll surface) causes varying expansion in the roll surface and hence, varying flatness in the strip. The temperature profile of the roll surface temperature changes over time as the mill stand heats up with use and eventually reaches a steady state condition.

Accordingly, a need remains for a system to compensate for the varying thermal expansion of the rolls in a strip mill stand to obtain a strip which is fiee fiom quarter buckle defects.

SUMMARY OF THE INVENTION

This need is met by the rolling mill stand of the present invention which includes a pair of rolls axially slidable relative to each other and configured to receive a moving strip of metal in a gap therebetween and defining a roll gap profile. Each roll has a ground roll profile wherein the diameter of each roll varies along the length of the roll according to the seventh order equation represented by EQ1

$$D(Z_R)=C_0+A\,Z_R+B\,Z_R^2+CZ_R^3+D\,Z_R^4+E\,Z_R^5+F\,Z_R^6+G\,Z_R^7 \quad \text{EQ1}$$

wherein $Z_R$ is the normalized distance across the length of the face of the roll measured from the center of the roll. Preferably, the second order component of EQ1 is constant, most preferably, D is zero thereby eliminating the fourth order component from the roll shape. In the present invention, the roll gap profile formed by rolls ground to the specified shape can be adjusted to fully compensate for the effect of work roll thermal expansion and, thus, significantly reduce the formation of quarter buckles in the finished strip.

The rolling mill stand further includes a controlling system for adjusting the roll gap profile. The controlling system includes a thermal tracking system for determining the temperature profile of the rolls along the axial length of the roll and adjusting the roll gap profile based on the temperature profile. The rolls are cooled via a cooling spray system and are driven by a mill stand motor. The temperature profile is determined by modeling the temperature profile of the rolls based on the amount of coolant sprayed on the rolls and the amount of power delivered to the stand motor. The rolling mill stand further includes roll bending jacks and the controlling system further includes a mill set-up system for determining the bending and flattening of the work rolls and backup rolls caused by the force of the strip being reduced in the mill stand. The mill set-up system models the roll gap profile based on the roll temperature profile, deflection and flattening of the rolls and the desired flatness and profile of a strip exiting the rolling mill stand.

The present invention further includes a method of controlling flatness and profile of a strip rolled in a rolling mill stand having the steps of:

(a) providing a pair of side shiftable work rolls to form a gap therebetween, each roll having a ground roll profile wherein the diameter of each roll varies along the length of the rolls according to the seventh order equation represented by EQ1

$$D(Z_R)=C_0+AZ_R+BZ_R^2+CZ_R^3+DZ_R^4+EZ_R^5+FZ_R^6+GZ_R^7 \quad \text{EQ1}$$

wherein $Z_R$ is the normalized distance across the length of the face of the roll measured from the center of the roll;

(b) rolling a strip between the rolls; and (c) axially shifting the rolls such that the gap between the rolls varies along the length of the rolls according to the sixth order equation represented by EQ4

$$RPG(Z_M,S)=(HS+I)Z_M^2+(JS+K)Z_M^6 \quad \text{EQ4}$$

where $Z_M$ is the normalized distance from mill centerline and S is the normalized roll side shift position.

The gap between the rolls varies along the length of the rolls according to the sixth order equation represented by EQ5

$$RGP(Z_M,S)=P_0Z_M^2+[1/(S_{max}-S_{min})][(Q_2-Q_1)S+(Q_1S_{max}-Q_2S_{min})]Z_M^6 \quad \text{EQ5}$$

The step of setting the axially side shifting roll position includes determining the amount of thermal expansion of the rolls, conrtolling the amount of axial side shift of the rolls to compensate for the expansion of the rolls, and setting a bending jack force to compensate for the deflection of the rolls from the force of the strip. The rolls are rotated by a drive motor and the rolls are cooled by contacting the rolls with a coolant and wherein the amount of thermal expansion of the roll is determined by calculating a thermal profile for the rolls from the amount of power required by the motor to rotate the rolls and the amount of coolant delivered to the rolls. The step of adjusting the amount of axial side shift of the rolls further includes compensating for the thermal profile of the rolls to achieve acceptable flatness of the strip exiting the mill stand.

BRIEF DESCRIPTION OF THE DRAWINGS

Other features of the present invention will be further described in the following related description of the preferred embodiment which is to be considered together with the accompanying drawings wherein like figures refer to like parts and further wherein.

DETAILED DESCRIPTION OF PREFERRED EMBODIMENTS

The present invention includes a mill stand having a pair of side shiftable rolls and a variable roll gap profile described by a sixth order polynomial equation. The rolls may be a pair of side shifting work rolls for a four-high mill stand or intermediate rolls for a six-high mill stand.

The thermal camber increases as the rolling mill heats up and eventually reaches a steady state when the mill operating temperature becomes steady. The steady state thermal profile at a particular position across the length of a roll can be estimated at a particular position across the length of the roll using a mathematical model verified by measurements of actual temperatures across the roll surface immediately after rolling. The thermal expansion or thermal camber is determined as the increase in roll diameter of the roll from a cold state to a heated state.

Figure 1:
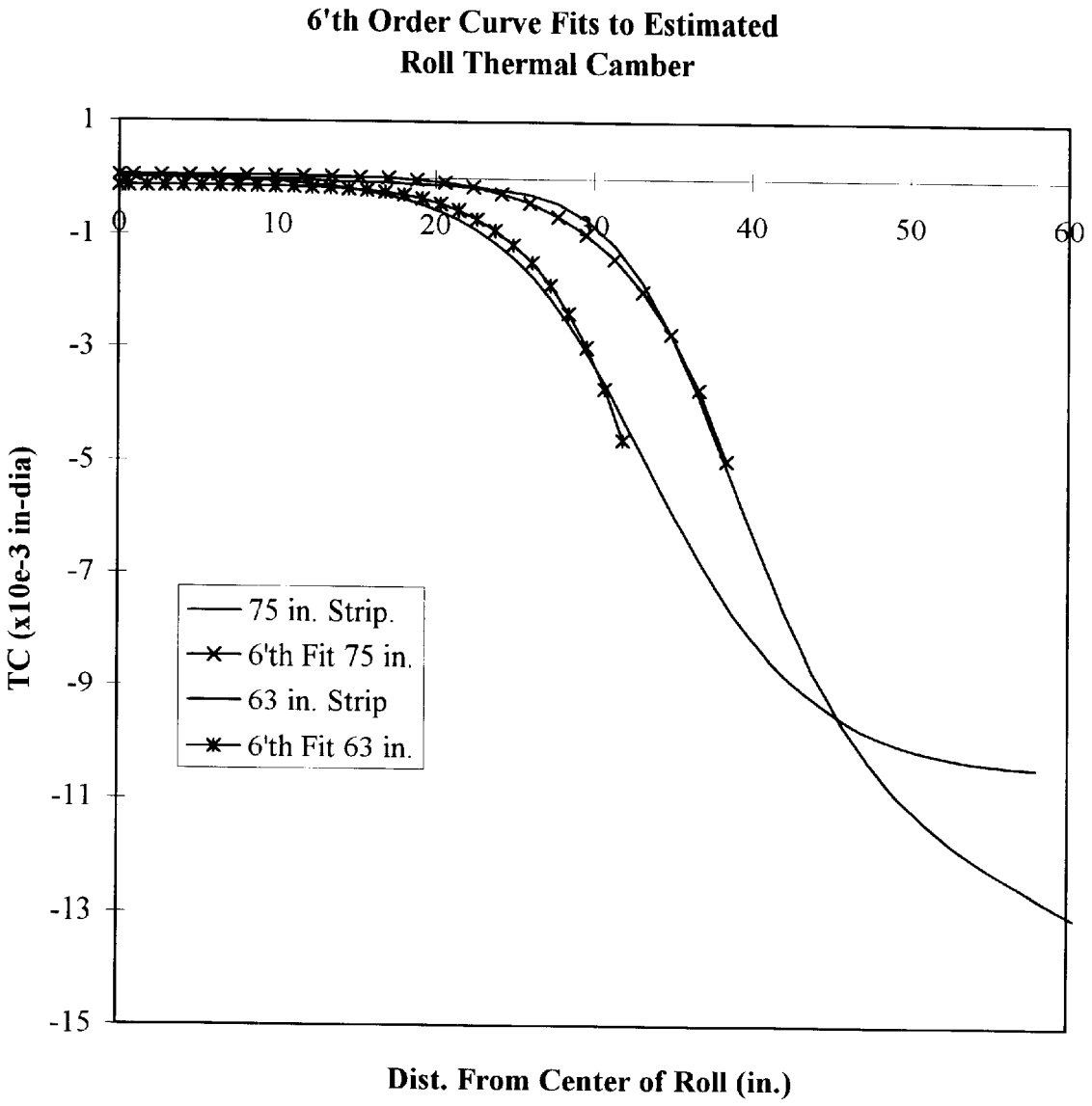
FIG. 1 is a graph of estimated thermal camber over the length of one half of work rolls and sixth order polynomial equation fitted thereto.

The estimated theimal camber (in inches) of work rolls at steady state rolling of 63 inch wide strip and 75 inch wide strip are shown in FIG. 1. The plot of the inches of thermal camber versus the distance from the center of the roll is referred to as the theirmal expansion profile. FIG. 1 also shows that sixth order polynomial curves fit the estimated thermal expansion profiles. Based on the recognition that the thermal expansion profile is fitted by a sixth order polynomial equation, the present invention includes rolls ground to have a surface profile (shape) which can be described as a seventh order polynomial equation. Although, an eight order polynomial equation is believed to produce an even better fit to the estimated thermal expansion profile, grinding of a roll to have a surface profile described by an eighth order polynomial profile is more difficult to accomplish and is not believed to be necessary. Hence the present invention is described hereinafter with respect to a surface profile based on seventh order polynomial equation, however, the present invention could be likewise based on an ninth order polynomial equation.

Each roll, work roll or intermediate roll, is ground such that the roll diameter varies across the length of the roll according to the equation EQ1:

$$D(Z_R)=C_0+AZ_R+BZ_R^2+CZ_R^3+DZ_R^4+EZ_R^5+FZ_R^6+GZ_R^7 \quad \text{EQ1}$$

wherein $D(Z_R)$ is the diameter of the roll (measured, e.g., in inches);

$Z_R$ is the normalized distance across face of the roll with the origin being located at center of the roll face;

$C_0$ is the nominal diameter of the roll (measured, e.g., in inches); and

A, B, C, D, E, F and G are each roll shape coefficients.

The roll shape equation EQ1 is useful for rolling mill analysis and set-up models. However, roll grinders work in an absolute distance coordinate system with the origin located at one end of the roll face rather than in the center. To convert fiom the normalized coordinate system to one useful for roll grinding, the following transformation of EQ2 is employed:

$$Z_R=(2/L_0)(X-L_0/2) \quad \text{EQ2}$$

where in $L_0$ is a length normalization term generally based on the backup roll face length, but other lengths, such as the work roll face length, are acceptable. Substituting for $Z_R$ in EQ1 yields the roll shape equation of EQ3 for the ground roll profile for grinding of the roll:

$$D(X)=C_0+C_1(X-L_0/2)+C_2(X-L_0/2)^2+C_3(X-L_0/2)^3+C_4(X-L_0/2)^4+C_5(X-L_0/2)^5+C_6(X-L_0/2)^6+C_7(X-L_0/2)^7 \quad \text{EQ3}$$

wherein

D(X) is the diameter of the roll (measured, e.g., in inches);

X is the distance across face of the roll with the origin being located at one end of roll face (measured, e.g., in inches);

$L_0$ is the normalizing length (measured, e.g., in inches); and $C_1$, $C_2$, $C_3$, $C_4$, $C_5$, $C_6$ and $C_7$ are roll grinding coefficients.

Values for the roll grinding coefficients are selected based on the required sixth order roll crown of the roll, the distance the rolls can be shifted, and the desired range of the parabolic crown. The relationships between the coefficients in the normalized roll shape (EQ1) equation and the roll grinding equation (EQ3) are as follows:

$$C_1=A(2/L_0)$$

$$C_2=B(2/L_0)^2$$

$$C_3=C(2/L_0)^3$$

$$C_4=D(2/L_0)^4$$

$$C_5=E(2/L_0)^5$$

$$C_6=F(2/L_0)^6$$

$$C_7=G(2/L_0)^7$$

To achieve the desired change to the roll gap profile as the rolls are shifted sideways, the odd numbered work roll grinding coefficients for the top and bottom rolls must have opposite signs. In other words, $C^T_i=-C^B_i$ where i is 1, 3, 5, or 7 and $C^T_i$ is the top work roll grinding coefficient and $C^B_i$ is the bottom work roll grinding coefficient.

Figure 2:
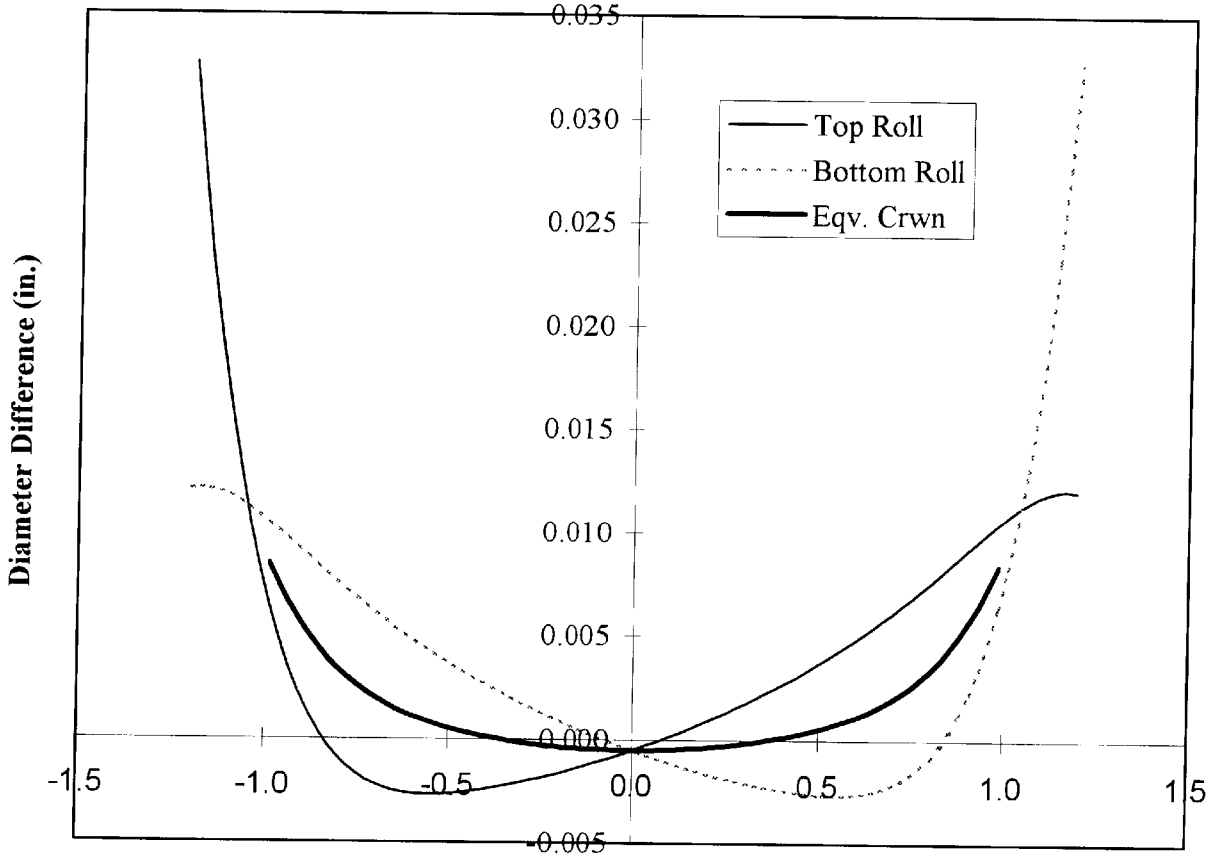
FIG. 2 is a graph of the work roll diameters and equivalent crown profile of the present invention.

FIG. 2 is a graph of the difference in the diameter of the top roll and of the bottom roll of the mill stand of the present invention from the nominal value of the roll diameter as a function of the normalized distance from the mid-point of the roll. The plots for the diameter differences for the top roll (solid line) and the bottom roll (dashed line) are described by equation EQ1. The equivalent roll crown (the dimension of the gap between the rolls referred to as the roll gap profile) experienced by strip passing between the rolls ground to have a seventh order polynomial surface profile is determined by combining the curves for the two rolls and is shown in FIG. 2 in the bold line.

The rolls are laterally moveable to defined locations referred to as side shift positions to adjust the effective profile of the gap formed between the rolls. When the rolls are shifted, they are moved the same distance in opposite directions. The effective roll gap profile for a given side shift position between a minimum side shift position (smallest distance roll may be shifted) and a maximum side shift position (greatest distance roll may be shifted) is represented by equation EQ4:

$$RPG(Z_M,S)=(HS+I)Z_M^2+(JS+K)Z_M^6 \quad \text{EQ4}$$

wherein $RPG(Z_M,S)$ is the effective profile of roll gap at distance $Z_M$ from the mill center line and rolls shifted by a distance S;

$Z_M$ is the normalized distance from the mill center line; and

S is the normalized roll side shift position.

The constants H, I, J and K are each determined by the minimum side shift position and the maximum side shift position for the mill. In particular, $H=(P_2-P_1)/(S_{max}-S_{min})$;

$I=(P_1S_{max}-P_2S_{min})/(S_{max}-S_{min})$;

$J=(Q_2-Q_1)/(S_{max}-S_{min})$; and $K=(Q_1S_{max}-Q_2S_{min})/(S_{max}-S_{min})$ wherein $P_2$ is the second order amplitude of the effective roll gap profile achieved at maximum side shift;

$P_1$ is the second order amplitude of the effective roll gap profile achieved at minimum side shift;

$Q_2$ is the sixth order amplitude of the effective roll gap profile achieved at maximum side shift;

$Q_1$ is the sixth order amplitude of the effective roll gap profile achieved at minimum side shift;

$S_{max}$ is the maximum normalized side shift position; and $S_{min}$ is the minimum normalized side shift position.

In a preferred embodiment, the parabolic component of the effective roll crown is constant so that as the rolls are shifted, only the sixth order component varies. This simplifies the equation EQ4 of the effective roll gap profile to EQ5:

$$RGP(Z_M,S)=P_0Z_M^2+[1/(S_{max}-S_{min})][(Q_2-Q_1)S+(Q_1S_{max}-Q_2S_{min})]Z_M^6 \quad \text{EQ5}$$

where $P_0$ is the second order amplitude of the effective roll gap profile for all side shift positions. In this preferred embodiment, the relationships between the parameters in the design equation for the effective roll gap profile (EQ5) and the coefficients of the equation that defines the diameter of each work roll along its horizontal axis (EQ1) are as follows:

A is a user-selected parameter;

$B=P_0$;

C 32 $(-10ES_{max}^2+15FS_{max}^3-21GS_{max})/3$;

D=0;

$E=3FS_{max}-7GS_{max}^2$;

$F=(Q_2S_{min}-Q_1S_{max})/(S_{max}-S_{min})$; and $G=(Q_2-Q_1)/[7(S_{max}-S_{min})]$.

Once these coefficients A through G are determined, the actual coefficients used by the roll grinding machine $C_i$ (i=0, 1, . . . , 7) can be computed as described above. By setting the coefficient D to zero, the fourth order component from the effective roll gap profile formed by the pair of side shifting rolls is suppressed. Coefficient A is a user-selected parameter that is chosen to minimize the maximum diameter difference of each of the work rolls. The value of A does not affect the shape of the roll gap profile formed by the roll set. The magnitude of the static parabolic component, $P_0$, is chosen to keep the work roll bending jack force within its operating range for all processing conditions and products generally rolled on the mill. The minimum value of the sixth order component of effective roll crown is usually chosen to be zero or a very small number. This corresponds to the setting needed for startup of the mill after a roll change or a long production delay. The maximum value for the sixth order component is selected by determining the amplitude required to cancel the steady state thermal profile of the work rolls developed when rolling the narrowest strip normally processed by the mill.

Figure 3:
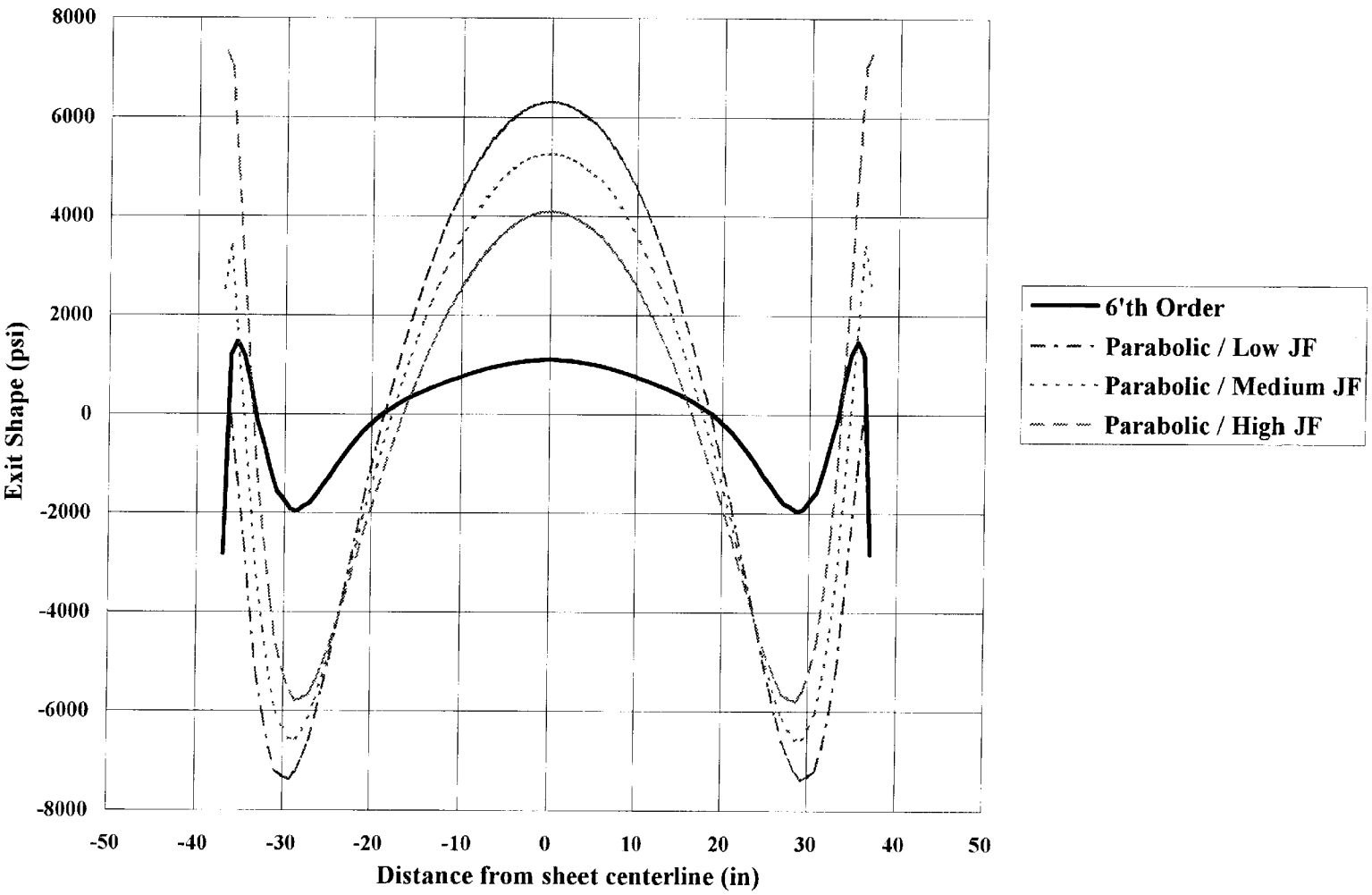
FIG. 3 is a graph of the strip shape versus distance from the strip centerline for the present invention and the prior art.

FIG. 3 is a model generated graph of the predicted shape of the strip exiting a rolling mill stand using the rolls of the present invention (solid line) and prior ait rolls ground with a parabolic profile (broken lines) at steady state mill operation. The shape of the strip is determined via the tension distribution (in pounds per square inch or psi) across the width of the sheet measured (in inches) from the centerline of the sheet. The prior art rolls exhibit high compressive tension at about 30 inches from the strip centerline which corresponds with quarter buckle defects. This phenomenon is not significantly altered when the jacking forces (JF) are varied between low (156 klbs/chock), medium (196 klbs/chock) and high (240 klbs/chock). In contrast, a low jacking force is used in the present invention. For example, a jacking force of only about 140 klbs/chock was included in the model which produced the data of FIG. 3. Use of the seventh order polynomial ground rolls essentially eliminated the quarter buckle defects.

Similar results were obtained in actual rolling tests conducted on a multistand hot continuous mill. Operation of the mill with prior alt rolls resulted in quarter buckle defects on most strip coils once the mill reached steady state heating. The resulting higher tension in the stlip edges can cause edge cracks to develop in certain situations. Upon installation of rolls ground according to the present invention to have diameters varying according to a seventh order polynomial equation, the quarter buckle defects and edge cracking was significantly reduced.

Figure 4:
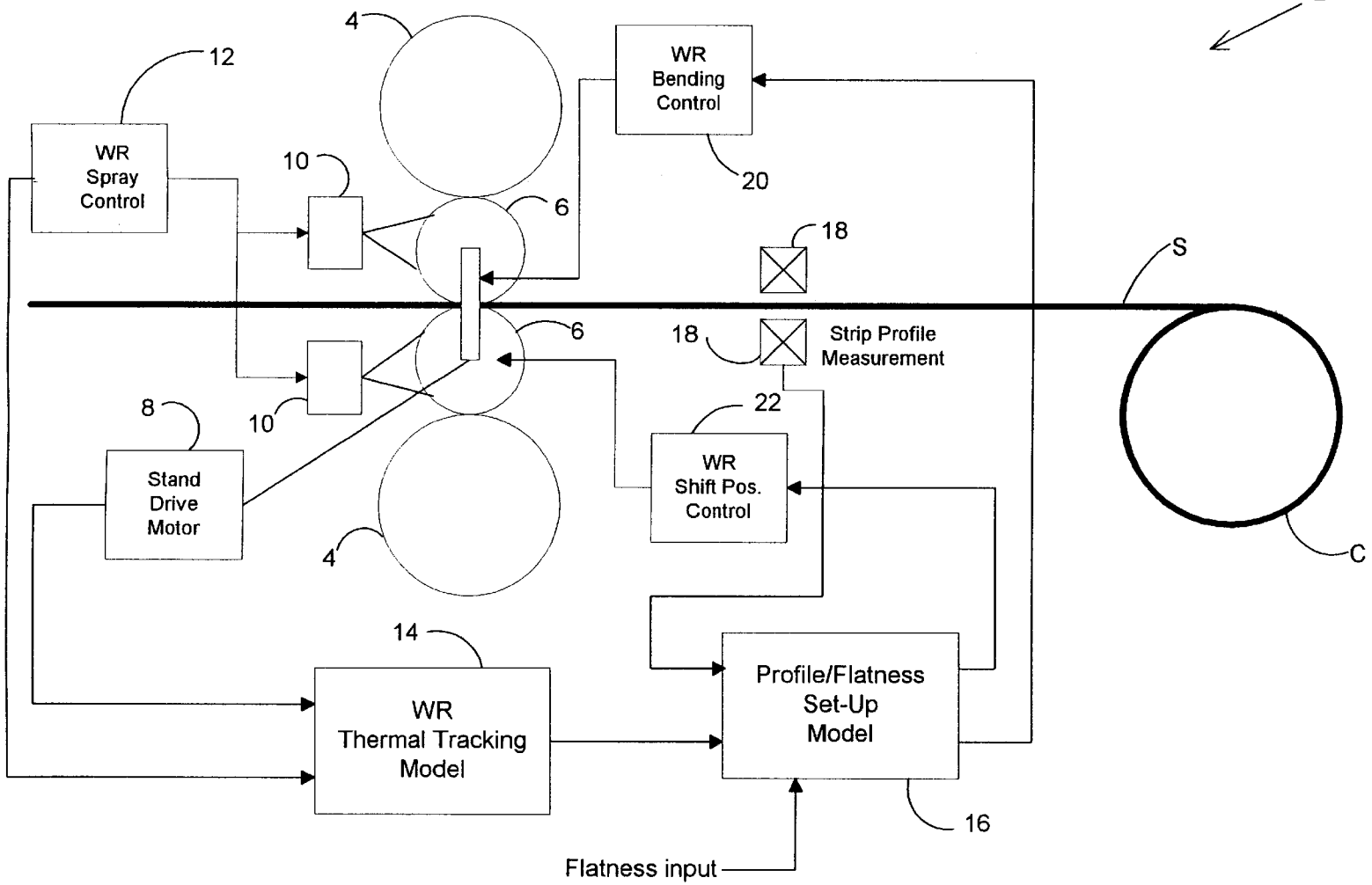
FIG. 4 is a diagram of the system of the present invention.

The present invention further includes a system and method for controlling flatness of a strip exiting a rolling mill stand. Referring to FIG. 4, the system 2 includes a pair of backup rolls 4 and a pair of side shiftable work rolls 6 defining a gap (not shown) having a variable roll gap profile. The work rolls 6 preferably have a seventh order polynomial suiface profile as described above (FIG. 2) and are driven by a stand drive motor 8. A strip S is reduced in the gap between the work rolls 6 and is coiled into a coil C. Cooling spray systems 10 deliver coolant to the rolls based on the temperature of the rolls and are controlled by a work roll spray controller 12.

The temperature of the work rolls varies along the length of the rolls (highest temperature at the centerline) and increases overall from start-up of the rolling mill stand until steady state is reached. A thermal profile of the work rolls 6 may be calculated in a computer-based work roll thermal tracking modeling system 14. The thermal profile calculation is based on data regarding the power delivered to the stand drive motor 8 and data from the work roll spray controller 12 regarding the number of spray nozzles that are turned on across the roll face, the temperature of the coolant and the coolant flow rate. The thermal tracking modeling system 14 determines the thermal profile of the work rolls 6 in terms of the roll temperature across the surface of the work rolls 6 and through the thickness of the work rolls 6. Specifically, the thermal tracking model includes a heat conduction model of a metal cylinder (a roll). The temperature distribution across the length of the cylinder and radially outward from the centerline of the cylinder is estimated by tracking the net heat input or output from the roll surface as the mill is rolling a strip and the roll is cooled by the cooling spray system 10. The model periodically evaluates the heat input to the roll by monitoring the power being delivered by the stand drive motor 8 and the amount of cooling from the cooling spray system 10 by determining if the sprays of the system 10 are on or off and evaluating the effect of the coolant temperature, coolant flow rate and distribution of the coolant on the roll surface. The temperature distribution across the roll surface is calculated. The corresponding thermal profile is then computed with another model that computes the expansion of the roll across the roll based on the estimated temperature distribution.

The estimated work roll thermal profile is provided to a computer-based profile/flatness set-up modeling system 16. The computer housing the thermal tracking modeling system 14 may also house the set-up modeling system 16. The set-up modeling system 16 calculates the necessary adjustment to the roll gap profile from the estimate of the work roll thermal profile, a predicted rolling force for the incoming strip S, and the characteristics of the product being rolled to achieve acceptable flatness and profile of the strip S exiting the work rolls 6. The flatness of the strip S exiting the work rolls may be determined by an operator who adjusts the profile/flatness set-up modeling system 16 based on visual inspection of the strip S.

The output of the computer-based set-up modeling system 16 provides the next settings for a bending control system 20 which controls the bending jacks (not shown) and for a roll side shift control system 22 which controls the side shifting of the work rolls 6. The set-up modeling system 16 predicts the expected force in the mill stand as the strip S is reduced in thickness when passing through the roll nip by analyzing the deformation process. In this analysis the metallurgical properties of the material, the temperature of the material, and the amount and rate of defomiation are considered. The set-up system also includes another model that predicts the mechanical bending and flattening of the work rolls 6 and the backup rolls 4 in response to the expected forces of the strip S. The amount of deflection of the work rolls 6, the thermal expansion profile, the ground roll crown and the roll flattening all determine the characteristics of the roll gap. The set-up modeling system 16 determines the amount of sixth order roll crown required to compensate for flattening of the work rolls 6 and the thermal expansion of the work rolls 6 and the bending force needed to compensate for the deflection of the rolls so that the roll gap characteristics match the profile of the entering strip. This match results in acceptable flatness of the strip exiting the mill stand. Once the magnitude of the sixth order crown is determined, the position settings for the side shiftable work rolls 6 are readily determined via an algebraic relationship between the effective roll crown and the shift position.

Having described the presently preferred embodiments, it is to be understood that the invention may be otherwise embodied within the scope of the appended claims.

What is claimed is:

1. In a rolling mill stand having a pair of rolls axially slidable relative to each other and being configured to reduce a moving strip of metal in a roll gap between the rolls, wherein a variable roll gap profile is adjustable by axially shifting the rolls, the improvement comprising:

each roll having a ground roll profile wherein the diameter of each roll varies along the length of the roll according to the seventh order equation $$D(Z_R)=C_0+AZ_R+BZ_R^2+CZ_R^3+DZ_R^4+EZ_R^5+FZ_R^6+GZ_R^7$$

wherein $Z_R$ is the normalized distance across the length of the face of the roll measured from the center of the roll.

2. The rolling mill stand of claim 1 wherein D is zero.

3. The rolling mill stand of claim 1 further comprising a controlling system for adjusting the roll gap profile.

4. The rolling mill stand of claim 3 wherein the controlling system comprises a thermal tracking system for determining the temperature profile of the rolls along the lengths of the rolls and adjusting the roll gap profile based on the temperature profile.

5. The rolling mill stand of claim 4 wherein the rolls are cooled via a cooling spray system and are driven by a mill stand motor and further wherein the roll temperature profile is determined by modeling the roll temperature profile of the rolls based on the amount of coolant sprayed on the rolls and the amount of power delivered to the stand motor.

6. The rolling mill stand of claim 4 further comprising roll bending jacks wherein the controlling system further comprises a mill set-up system for determining the bending and flattening of the rolls deformed by a strip in the mill stand, wherein the mill set-up system models the roll gap profile based on the roll temperature profile and the bending and the flattening of the rolls to achieve acceptable flatness of strip exiting the rolling mill stand.

7. The rolling mill stand of claim 6 further comprising a roll side shifter, the roll side shifter being configured to shift each roll axially.

8. In a rolling mill stand having a pair of rolls axially slidable relative to each other and being configured to reduce a moving strip of metal in a roll gap between the rolls, wherein a variable roll gap profile is adjustable by axially shifting the rolls, the improvement comprising:

the variable roll gap profile varies along the length of the rolls according to the sixth order equation $$RPG(Z_M,S)=(HS+I)Z_M^2+(JS+K)Z_M^6$$

wherein $Z_M$ is the normalized distance from mill center line; and

S is the normalized roll side shift position.

9. The method of claim 8 wherein the gap between the rolls varies along the length of the rolls according to the sixth order equation $$RGP(Z_M,S)=P_0Z_M^2+[1/(S_{max}-S_{min})][(Q_2-Q_1)S+(Q_1S_{max}-Q_2S_{min})]Z_M^6,$$

wherein $P_0$ is the second order amplitude of the effective roll gap profile for all side shift positions;

$S_{max}$ is the maximum normalized side shift position; and $S_{min}$ is the minimum normalized side shift position;

$Q_2$ is the sixth order amplitude of the effective roll gap profile achieved at maximum side shift; and $Q_1$ is the sixth order amplitude of the effective roll gap profile achieved at minimum side shift.

10. The rolling mill stand of claim 8 further comprising a controlling system for adjusting the roll gap profile, the controlling system having a thermal tracking system for determining the temperature profile of the rolls along the lengths of the rolls and adjusting the roll gap profile based on the temperature profile.

11. A method of controlling flatness of a strip rolled in a rolling mill stand comprising the steps of (a) providing a pair of side shiftable work rolls to form a gap therebetween, each roll having a ground roll profile wherein the diameter of each roll varies along the length of the rolls according to the seventh order equation $$D(Z_R)=C_0+AZ_R+BZ_R^2+CZ_R^3+DZ_R^4+EZ_R^5+FZ_R^6+GZ_R^7$$

wherein $Z_R$ is the normalized distance across the length of the face of the roll measured from the center of the roll;

(b) rolling a strip between the rolls; and (c) axially shifting the rolls between a maximum side shift position and a minimum side shift position such that the gap between the rolls varies along the length of the rolls according to the sixth order equation $$RPG(Z_M,S)=(HS+I)Z_M^2+(JS+K)Z_M^6$$

wherein $Z_M$ is the normalized distance from mill center line; and

S is the normalized roll side shift position.

12. The method of claim 11 wherein the gap between the rolls varies along the length of the rolls according to the sixth order equation $$RGP(Z_M,S)=P_0Z_M^2+[1/(S_{max}-S_{min})][(Q_2-Q_1)S+(Q_1S_{max}-Q_2S_{min})]Z_M^6,$$

wherein $P_0$ is the second order amplitude of the effective roll gap profile for all side shift positions;

$S_{max}$ is the maximum normalized side shift position; and $S_{min}$ is the minimum noimalized side shift position;

$Q_1$ is the sixth order amplitude of the effective roll gap profile achieved at minimum side shift; and $Q_2$ is the sixth order amplitude of the effective roll gap profile achieved at maximum side shift.

13. The method of claim 12 wherein said step of axially side shifting the rolls comprises determining the amount of thermal expansion of the rolls and controlling the amount of axial side shift of the rolls to compensate for the thermal expansion of the rolls.

14. The method of claim 13 wherein the rolls are rotated by a drive motor and the rolls are cooled by contacting the rolls with a coolant and wherein the amount of thermal expansion of the roll is determined by calculating a thermal profile for the rolls from the amount of power required by the motor to rotate the rolls and the amount of coolant delivered to the rolls.

15. The method of claim 14 wherein said step of adjusting the amount of axial side shift of the rolls further comprises compensating for the flatness of the strip exiting the mill stand.

* * * * *